US005382186A

United States Patent [19]

West

[11] Patent Number: 5,382,186

[45] Date of Patent: Jan. 17, 1995

[54] SIMULATED TOY TEETH

[76] Inventor: Marjorie E. West, 628 S. A. Rd., Arvada, Wyo. 82831

[21] Appl. No.: 249,227

[22] Filed: May 25, 1994

[51] Int. Cl.[6] ..... A63H 3/02

[52] U.S. Cl. ..... 446/372; 446/395

[58] Field of Search ..... 446/369-372, 446/391, 394, 395, 368

[56] References Cited

U.S. PATENT DOCUMENTS

| | | | |
|---|---|---|---|
| 1,554,712 | 9/1925 | Clark | 446/369 |
| 2,535,818 | 12/1950 | Smalley | 446/370 |
| 5,141,465 | 8/1992 | Stellman | 446/395 X |

*Primary Examiner*—Mickey Yu

*Attorney, Agent, or Firm*—Risto A. Rinne, Jr.

[57] ABSTRACT

A plurality of simulated toy teeth and method for making are described for use with toys including toy stuffed animals and toy dolls. The teeth include a flexible tubular casing that is expanded by placing a fill material therein. The ends of the casing are sealed to contain the fill material. At least one constrictive band is placed around at least a portion of the casing which compresses both the casing and the fill material therein thereby reducing the overall circumference of the casing underneath the band. The visual effect is to provide a plurality of teeth, one of each of the teeth being disposed on either side of each constrictive band. The flexible casing is curved as desired to accommodate the shape of the toy and is then attached as desired to the toy.

16 Claims, 1 Drawing Sheet

SIMULATED TOY TEETH

BACKGROUND OF THE INVENTION

1. Field of the Invention

The present invention, in general, relates to toys and, more particularly, to simulated toy teeth for the visual enhancement of toy stuffed animals and toy dolls.

Manufacturers of toy stuffed animals and toy dolls continually strive to either improve realism, or to add greater visual impact to their toys. If the toy stuffed animals appear more realistic or if they merely seem to "stand out" when compared with other similar types of toys, they are then more likely to be purchased. Accordingly any of the features and characteristics of toy stuffed animals and toy dolls are varied in an attempt to enhance their appearance, and, ultimately to improve sales.

In particular the eyes and mouth contribute a disproportionate amount of visual impact to such kinds of toys. Current types of toy eyes are inexpensive to manufacture and generally have been capable of adding the desired dramatic expression to toy stuffed animals and toy dolls.

However, simulated toy teeth for the visual enhancement of toys have proven to be difficult to produce inexpensively and therefore toy manufacturers have relied upon types of simulated toy teeth that are less than ideal. Also presently known types of simulated toy teeth are difficult to attach to toy stuffed animals and to dolls. Plastic and other types of toy teeth, if not adequately attached, pose a choking hazard to small children who might bite or otherwise pry the teeth off of the toy.

Accordingly there exists today a need for simulated toy teeth for use with toy stuffed animals and toy dolls that are inexpensive to manufacture, easy to attach, resistant to removal apart from the toy, and which are capable of creating a preferred type of visual effect.

2. Description of Prior Art

Simulated toy teeth for use with toy stuffed animals and toy dolls are, in general, known. However simulated toy teeth constructed in accordance with the principals of the present invention are not believed to be presently known.

While the structural arrangements of the known types of simulated toy teeth may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide simulated toy teeth that are easy to manufacture.

It is also an object of the invention to provide simulated toy teeth that are inexpensive to manufacture.

Another object of the invention is to provide simulated toy teeth that are easy to attach to a toy stuffed animal or to a doll.

Still another object of the invention is to provide simulated toy teeth that are capable of creating a desired visual effect upon the viewer.

Yet another object of the invention is to provide simulated toy teeth that are resistant to removal apart from the toy stuffed animal or toy doll to which they are attached.

Briefly, simulated toy teeth that are constructed in accordance with the principles of the present invention have a flexible tubular casing preferably formed of a fabric. A fill material such as cotton or the like is inserted in the casing to provide bulk sufficient to fill and to expand the casing to a predetermined overall circumference. The ends of the casing are sealed or otherwise obstructed so as to prevent loss of the fill material. At least one constrictive band is placed around at least a portion of the circumference of the casing. The constrictive band compresses both the casing and the fill material therein thereby reducing the overall circumference of the casing under where the band is placed. The visual effect is to simulate teeth by producing at least one depression in the casing which appears to separate the casing into a plurality of simulated teeth that are disposed on either side of each of the constrictive bands that are used.

DETAILED DESCRIPTION OF THE INVENTION

Figure 2:
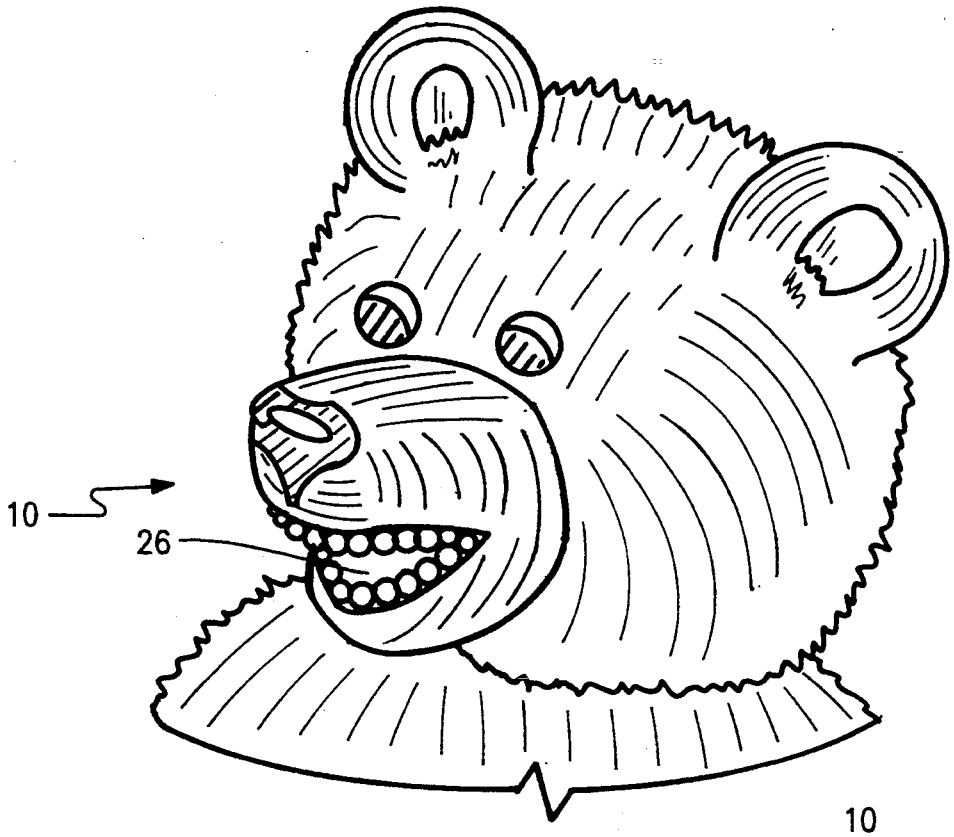
FIG. 2 is a view in perspective of the simulated toy teeth attached to a toy stuffed animal.
Figure 1:
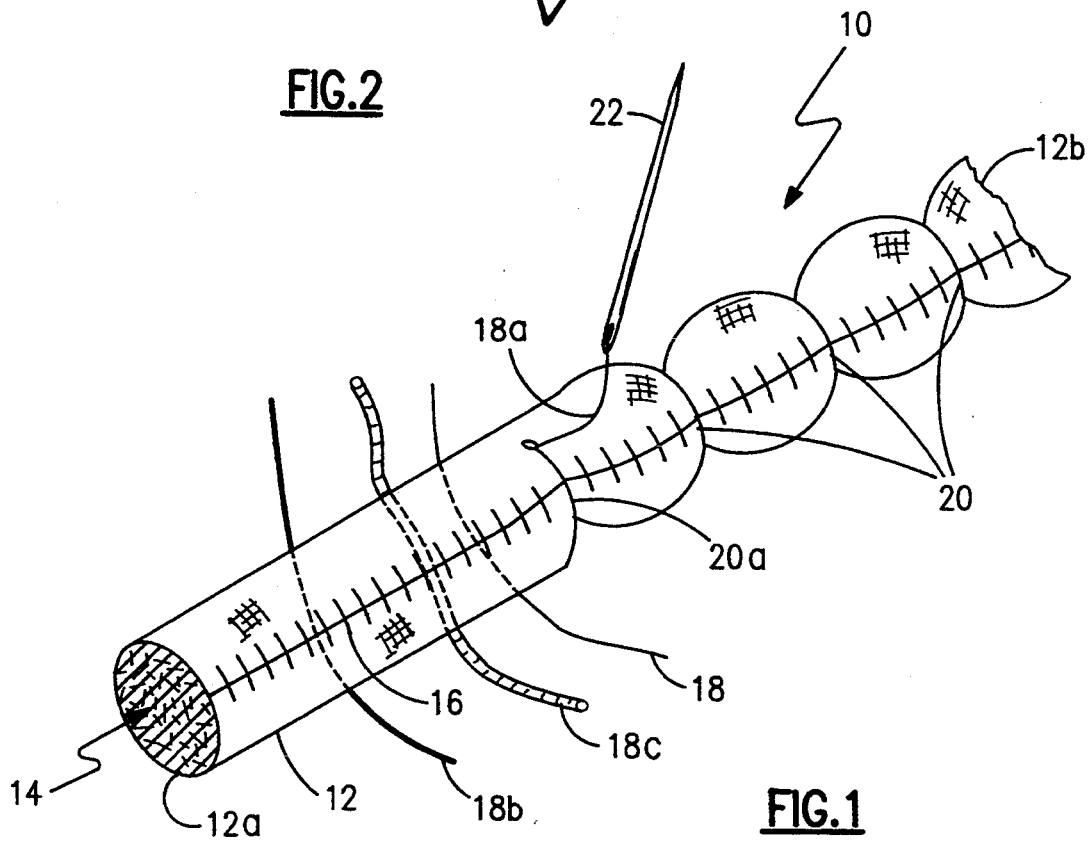
FIG. 1 is a view in perspective showing partial construction of the presently disclosed simulated toy teeth.

Referring primarily to FIG. 1 and on occasion to FIG. 2 are shown simulated toy teeth, identified in general by the reference numeral 10.

An outer flexible casing 12 is provided for containing a fill material, identified in general by the reference numeral 14. The casing 12 is formed of any suitable flexible material which forms, essentially, a hollow tubular conduit in which the fill material 14 is inserted and is thereafter contained therein.

Many varieties of material are suitable for use to form the casing 12 providing the material is flexible and is capable of containing the fill material 14. Typically, any type of a fabric is a preferred material for use to construct the casing 12.

The preferred color for the fabric is white when it is desirable to provide white looking teeth 10, although any color of casing 12 may be used to provide any particular desired visual effect. For example, the casing 12 can be yellow in color for use with a "tea" drinker or "smoker" type of a doll (not shown) or with a "honey" eating type of a bear (not shown) to emphasize a particular desired theme.

The casing 12 as shown in FIG. 1 is formed of a material that is sewn together along a seam 16. The seam 16 runs parallel with the longitudinal axis of the casing 12. Usually to hide the seam 16, the casing 12 is sewn whilst it is inside out, and is then turned right side out so as to orient the bulk of the stitching (not shown) of the seam 12 on the inside of the casing 12. Of course a modified casing (not shown) can be provided that has no seam 16.

The fill material 14 includes any type of a bulk substance which can be inserted inside of the casing 12 for the purpose of expanding the casing 12. Cotton, synthetic fibers, and other like materials are suitable for use as the fill material 12 as are many other kinds of substances too diverse to specifically iterate herein.

However, in addition to providing the bulk necessary to expand the casing 12, the fill material 14 must of itself also be compressible for reasons as are described in greater detail hereinbelow. The fill material 14 is disposed within the casing 12 along its longitudinal length.

A length of thread 18 is shown loosely placed around a circumference of the casing 12. The thread 18 is then tightened around the casing 12 sufficient to compress the casing 12 and to reduce the effective circumference about where it is placed.

The thread 18 is then tied into a knot to secure it in position thereby maintaining the desired amount of constriction. Accordingly, a constrictive band 20 is thus produced, wherein as few as one thread 18 can be used or as many threads 18 are used to form as many constrictive bands 20 about the casing 12 as are desired. The thread 18 that is used to form each of the constrictive bands 20 can, of course, be replaced by a string, a rubber band, or by any other type of a material (not shown) that can be placed around the casing 20 in order to reduce the circumference.

Each constrictive band 20 is disposed apart with respect to each of the other constrictive bands 20 separated by a predetermined distance. The visual effect of placing a constrictive band 20 around the casing 12 is to produce a depression in the casing 12 which appears visually to separate the casing 12 into a plurality of simulated toy teeth that are disposed adjacent with respect to each other and disposed on either side of the constrictive band 20. The constrictive band 20 thereby provides what appears visually to look like the separations that exist between normal healthy real teeth.

Additional constrictive bands 20 are used with as long a casing 12 as is necessary to create a row of the simulated toy teeth 10 as long as is desired. By further tightening of the threads 18, deeper depressions are thereby formed by the constrictive bands 20 to provide alternative types of desired visual effects. For example, deeper depressions in the constrictive bands 20 add greater drama to the teeth, and as such would appear to make a toy dinosaur (not shown) more menacing if used for such an application.

An alternative type of constrictive band **20*a* is used as desired in place of the constrictive band 20. The alternative type of contrictive band 20*a* serves the same purpose and is constructed the same as the constrictive band 20 except that a modified thread 18a is used that does not completely encircle the entire circumference of the casing 12**.

A first end of the modified thread **18*a*, as shown, is attached to a sewing needle 22 that is passed through a portion of the casing 12. The modified thread 18*a* also encircles a portion of the circumference of the casing 12 sufficient to produce a visible reduction in the circumference of the casing 12 around that portion of the casing 12** about which it is tightened.

Accordingly, to produce the simulated toy teeth 10, it is not necessary to fully encircle the entire circumference of the casing 12 with the modified thread **18*a*, but rather, only enough of the casing 12** need be encircled sufficient to produce the desired visible reduction in the overall circumference.

The second end of the modified thread **18*a* is not shown and is either fastened or tied in position to the casing 12 to secure it thereto or it is tied to the first end of the modified thread 18*a* to secure it in position and to maintain a desired lesser circumference about the casing 12**.

The casing 12 is partially completed as shown in the FIG. 1 drawing. Additional threads 18 are required to be placed around the casing 12 where desired, tightened, and then tied (knotted) to form a new set of additional constrictive bands (not shown).

In addition as mentioned hereinabove, other types of materials are suitable for use in making the constrictive bands 20 other than the threads 18. Accordingly, a second type of modified thread **18*b* that is formed of string is shown, and a third type of modified thread 18*c*** that is formed of an elastomeric material is also shown.

The string that is used to make the second type of modified thread **18*b* can, of course, be of any natural or synthetic material. The third type of modified thread 18*c* is formed of an elastomeric material and is shown as having two ends (not identified by reference numerals), although it is considered obvious to substitute a continuous loop of elastomeric material, such as a rubber band, in substitution thereof for the third type of modified thread 18*c*** material. A continuous loop of elastomeric material eliminates the need to tie the two ends together for use with certain applications.

The casing 12 includes a first casing end **12*a* and a second casing end 12*b*. The first casing end 12*a*, as shown, is open to permit view of the fill material 14. The second casing end 12*b* is sealed or otherwise obstructed so as to prevent the fill material 14 from escaping out from inside of the casing 12**.

The second casing end **12*b*, as shown, is either sewn or glued together to provide the preferred type of a seal for the fill material 14. Of course the second casing end 12*b* could equally well be sealed at the time that it is actually attached to the toy stuffed animal or to the doll by any method that is preferred. Similarly, the first casing end 12*a*** is also sealed.

After all of the desired constrictive bands 20 have been placed around the casing 12, the simulated toy teeth 10 are ready for attachment to a toy, as desired. Referring now in particular to FIG. 2, the simulated toy teeth 10 have been attached to a teddy bear, identified in general by the reference numeral 24.

The teeth 10 are first curved to correspond with the shape of a mouth 26 of the bear 24 and are then attached thereto by any method that is preferred including, but not limited to, sewing or gluing of the teeth 10 to the mouth 26 of the bear 24.

When the teeth 10 are attached to the bear 24, they are quite resistant to removal apart from the bear 24, and accordingly, lessen any possibility of injury occuring as a result of their removal therefrom. While the teeth 10 are shown attached in particular to the bear 24, this is for the purpose of providing an illustration of their use. It is of course considered obvious to those now skilled in the art to attach the teeth 10 to whatever type of a toy stuffed animal (not shown) or a doll (not shown) that is preferred.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A plurality of simulated toy teeth for use with the mouth of a toy figurine, comprising:

a) a flexible hollow tubular casing having a first end and a second end;

b) a fill material that is disposed inside of said casing, said fill material providing bulk sufficient to expand said casing and being compressible in response to a sufficient force that is applied to the outside of said casing;

c) means for sealing said first end and said second end of said casing; and d) means for reducing at least a portion of the circumference of said casing whereby said means for reducing supplies a force sufficient to compress said casing and said fill material disposed therein to reduce said portion of the circumference thereof.

2. The simulated toy teeth of claim 1 wherein said tubular casing is formed of a fabric.

3. The simulated toy teeth of claim 1 wherein said tubular casing includes a seam.

4. The simulated toy teeth of claim 1 wherein said fill material includes natural fibers.

5. The simulated toy teeth of claim 1 wherein said fill material includes synthetic fibers.

6. The simulated toy teeth of claim 1 wherein said means for sealing includes a plurality of stitch means.

7. The simulated toy teeth of claim 1 wherein said means for sealing includes adhesive means.

8. The simulated toy teeth of claim 1 wherein said means for reducing includes at least one constrictive band disposed around said portion of said circumference of said casing.

9. The simulated toy teeth of claim 8 wherein said at least one constrictive band is formed of a thread.

10. The simulated toy teeth of claim 8 wherein said at least one constrictive band is formed of a string.

11. The simulated toy teeth of claim 8 wherein said at least one constrictive band is formed of an elastomeric material.

12. The simulated toy teeth of claim 1 including means for attaching said simulated toy teeth to said toy.

13. The simulated toy teeth of claim 12 wherein said means for attaching includes a plurality of stitch means.

14. The simulated toy teeth of claim 12 wherein said means for attaching includes adhesive means.

15. A method of making simulated toy teeth for use with the mouth of a toy figurine, which comprises:

a) expanding a flexible tubular casing by placing a fill material therein;

b) sealing the ends of the casing to contain the fill material; and c) placing at least one constrictive band around at least a portion of the circumference of the casing for reducing the circumference of the casing under said band.

16. A method of making simulated toy teeth for use with the mouth of a toy figurine, which comprises:

a) expanding a flexible tubular casing by placing a fill material therein;

b) sealing the ends of the casing to contain the fill material;

c) placing at least one constrictive band around at least a portion of the circumference of the casing for reducing the circumference of the casing under said band; and d) attaching the simulated toy teeth to the toy.

* * * * *